United States Patent [19]

Sotome et al.

[11] Patent Number: 4,957,052

[45] Date of Patent: Sep. 18, 1990

[54] TRIPLE FOLDING DEVICE FOR FOLDING A TOWEL HEM

[75] Inventors: Kenichi Sotome, Utsunomiya; Munetaka Nagasaki, Kadoma, both of Japan

[73] Assignee: SSMC Inc., Edison, N.J.

[21] Appl. No.: 338,818

[22] Filed: Apr. 17, 1989

[30] Foreign Application Priority Data

May 24, 1988 [JP] Japan ..... 63-125029

[51] Int. Cl.[5] ..... D05B 35/04

[52] U.S. Cl. ..... 112/147; 112/121.12

[58] Field of Search ..... 112/147, 121.12, 121.26, 112/141

[56] References Cited

U.S. PATENT DOCUMENTS

| | | | |
|---|---|---|---|
| 3,906,878 | 9/1975 | Burton | 112/141 X |
| 4,548,146 | 10/1985 | Okada | 112/121.26 X |
| 4,607,582 | 8/1986 | Brocklehurst | 112/318 X |
| 4,624,200 | 11/1986 | Fisher | 112/141 X |
| 4,760,809 | 8/1988 | Nakatani et al. | 112/141 |

*Primary Examiner*—Andrew M. Falik

*Attorney, Agent, or Firm*—Theodore Jay

[57] ABSTRACT

A triple folding device for folding a hem of a towel utilizes four cams respectively driven by a single rotative drive source, and four link mechanisms respectively driven by corresponding cams. A guide ruler secured to a first guide shaft is driven by one of the link mechanisms. A thrust block is connected to and driven by another one of the link mechanisms. An upper presser is secured to a second guide shaft which is driven by yet another link mechanism. Another second thrust block is connected to and driven by yet another link mechanism. A lower presser is positioned under the upper presser. A pressing unit is driven by a second drive unit. A guide ruler is moved vertically and horizontally by the vertical motion of the first guide shaft and the horizontal motion of the first thrust block for guiding a hem of a towel. The lower presser is moved horizontally by a first drive unit to press the hem of the towel. The upper pressure is moved vertically and horizontally by the vertical motion of the second guide shaft and the horizontal motion of the second thrust block for folding the hem of the towel positioned between the lower presser and a working table. The lower presser is moved horizontally by a first drive unit to press the hem of the towel.

5 Claims, 5 Drawing Sheets

TRIPLE FOLDING DEVICE FOR FOLDING A TOWEL HEM

BACKGROUND OF THE INVENTION

1. Field of the Invention:

The present invention relates to a triple folding device for folding the hem of a towel.

2. Description of the Prior Art:

There is a prior art triple folding device of this type as disclosed in Japanese Patent Publication No. 61-7119 for folding the hem of the towel in triple and having a single folding ruler, a double folding ruler and a guide ruler.

However, there are such problems in the prior art triple folding device that six driving means are required as well as a complex control unit for individually controlling these driving means. The six driving means are: a first means for driving the single folding ruler in a vertical direction; a second means for driving the single folding ruler in inner and outer directions; a third means for driving the double folding ruler in a vertical direction; a fourth means for driving the double folding ruler in inner and outer directions; a fifth means for driving the guide ruler in a vertical direction, and a sixth means for driving the guide ruler in inner and outer directions.

Furthermore, since the hem of the towel is folded in double by the single folding ruler and in triple by the double folding ruler, and the hem of the towel is pressed by both the single folding ruler and the double folding ruler, both the single folding ruler and the double folding ruler have to be substantially strengthened.

SUMMARY OF THE INVENTION

It is therefore an object of the present invention to provide a triple folding device for folding a hem of a towel which overcomes the problems of the prior art triple folding device.

Another object of the present invention is to provide a triple folding device for folding a hem of a towel having a guide ruler and an upper presser having a simplified control unit employing simultaneously operated cams for driving a guide ruler and an upper presser.

Yet another object of the present invention is to provide a triple folding device for folding the hem of the towel wherein the hem of the towel is pressed only by the lower presser.

In accordance with the invention, a triple folding device for folding a hem of a towel comprises a working table secured to a body of an automatic sewing machine to which the towel material is delivered from the cutting unit. A guide ruler is secured to a guide ruler holder and is positioned over the working table 2. The guide ruler presses a hem of a towel while a portion yet to be folded remains at the end of the towel and also guides the hem of the towel while restricting the hem at the edge portion of the guide ruler. An upper presser is secured to an upper presser holder for folding the hem of the towel. A lower presser is positioned at the lower portion of the upper presser and is driven by a first drive unit for pressing the hem of the towel down on the working table. A pressing unit presses and holds the folded hem of the towel laid between the working table and the pressing unit. A first link mechanism moves the guide ruler horizontally by converting a motion of a first cam to a horizontal motion of the guide ruler. A second link mechanism moves the guide ruler vertically by converting a swinging motion of a second cam to a vertical motion of the guide ruler. A third link mechanism moves the upper presser vertically by converting a swinging motion of a third cam to a vertical motion of the upper presser. A fourth link mechanism moves the upper presser horizontally by converting a swinging motion of a fourth cam to a horizontal motion of the upper presser. A first drive unit drives the lower presser **18*b*, and a second drive unit drives the pressing unit 41**.

The above and other objects, features and advantages of the present invention will become more apparent from the following description taken in conjunction with the accompanying drawings.

DESCRIPTION OF THE PREFERRED EMBODIMENT

A triple folding device for folding the hem of the towel in accordance with a preferred embodiment of the present invention will be described with reference to FIGS. 1–4.

Figure 1:
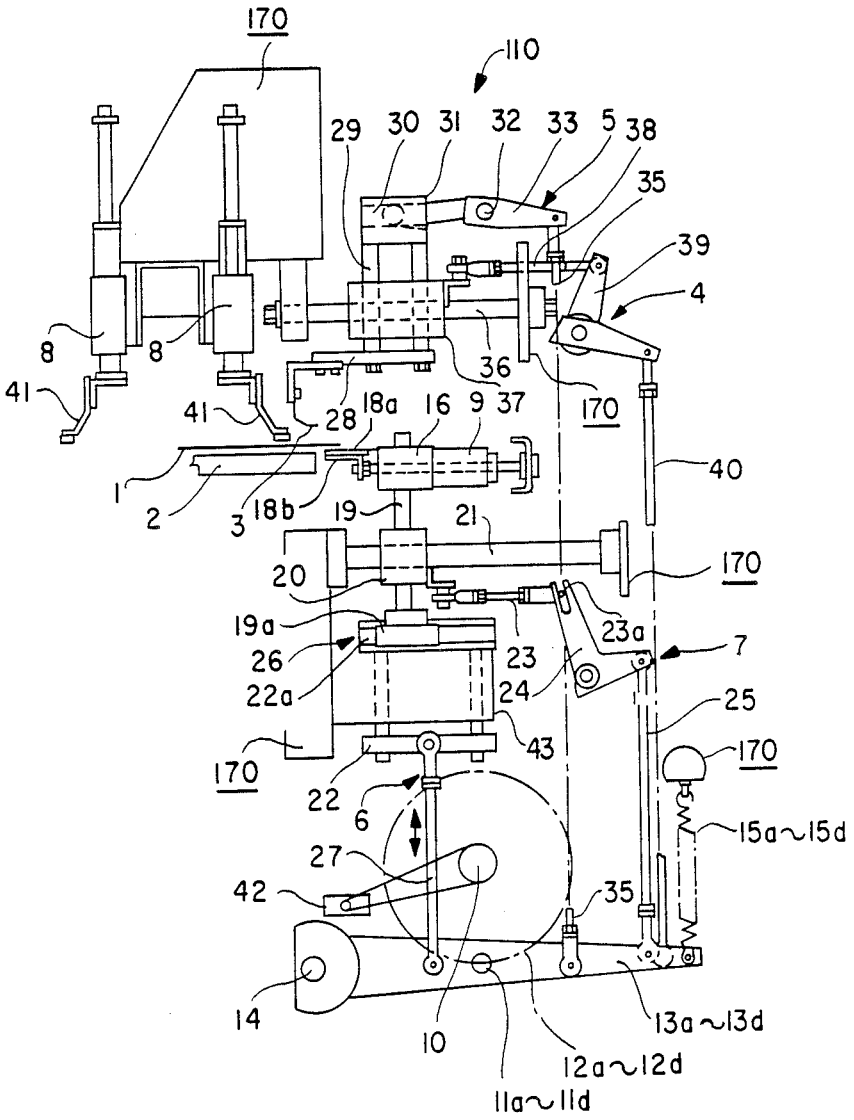
FIG. 1 is a front elevation view showing a triple folding device for folding a hem of a towel in accordance with a preferred embodiment of the present invention.
Figure 2:
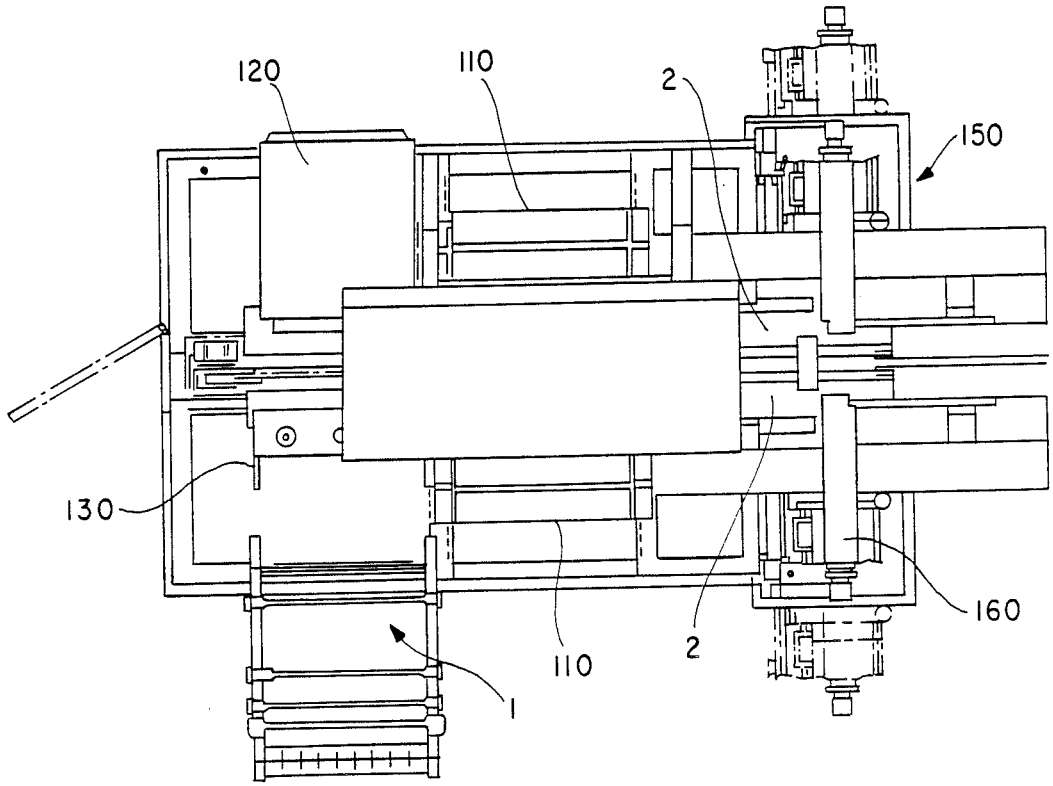
FIG. 2 is a plan view showing an automatic sewing machine employing the triple folding device for folding a hem of a towel according to the present invention.
Figure 3:
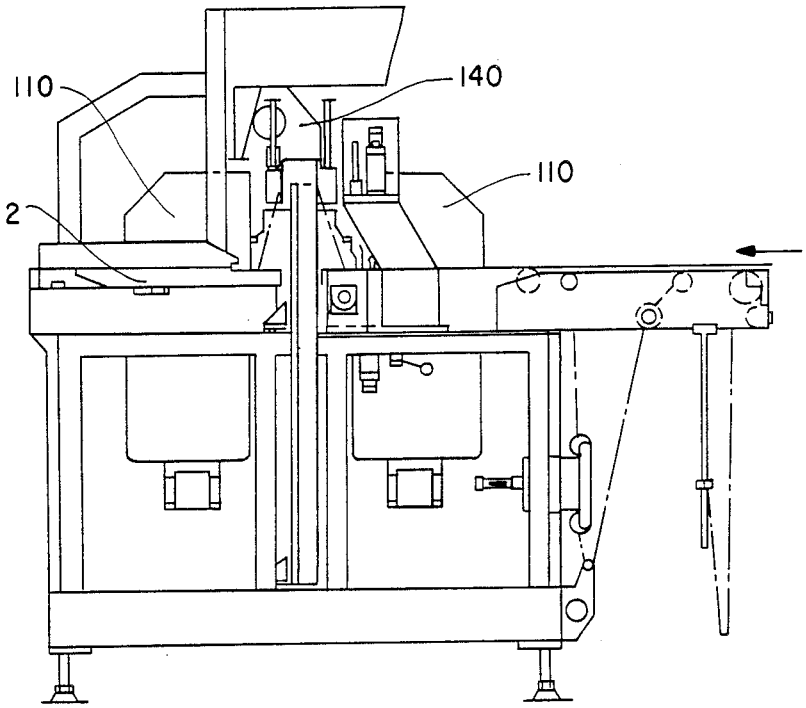
FIG. 3 is a side elevational view showing the automatic sewing machine of FIG. 2.

Referring to FIGS. 2–3, an automatic sewing machine for sewing the hem of a towel includes a triple folding device 110, a clamp unit 120 for drawing a towel material, a cutting unit 130 positioned aside the clamp unit 120 (in FIG. 2) for cutting the towel material in a predetermined length, a delivering unit 140 for delivering the towel material (both hems of which have been folded in triple by the triple folding device 110) to a stitching portion 150, and a sewing machine 160 where the towel material having triple folded hems is sewn.

The triple folding device 110 as shown in FIG. 2 employs a working table 2 secured to a body 170 of the automatic sewing machine to which the towel material 1 is delivered from the cutting unit 130. A guide ruler 3 is secured to a guide ruler holder 28 and is positioned over the working table 2 for pressing a hem of the towel 1 while a portion to be folded remains at the end of the towel. Ruler 3 guides the hem of the towel while the hem is restricted at the edge portion of the guide ruler 3. An upper presser **18*a* is secured to an upper presser holder 16 for folding the hem of the towel 1. A lower presser 18*b* is positioned at the lower portion of the upper presser 18*a* and is driven by a first drive unit 9 for pressing the hem of the towel down on the working table 2. A pressing unit 41 presses and holds the folded hem of the towel laid between the working table 2 and the pressing unit 41. A first link mechanism 4 moves the guide ruler 3 horizontally by converting a swinging motion of a first cam 12*a* to a horizontal motion of the guide ruler 3. A second link mechanism 5 moves the guide ruler 3 vertically by converting a swinging motion of a second cam 12*b* to a vertical motion of the guide ruler 3. A third link mechanism 6 moves the upper presser 18*a* vertically by converting a swinging motion of a third cam 12c to a vertical motion of the upper presser 18a. A fourth link mechanism 7 moves the upper presser 18a horizontally by converting a swinging motion of a fourth cam 12d to a horizontal motion of the upper presser 18a. A first drive unit 9 drives the lower presser 18b, and a second drive unit 8 drives the pressing unit 41**.

The first cam 12a, the second cam 12b, the third cam 12c and the fourth cam 12d are respectively fixed to a main shaft 10 which is driven by a rotative drive source 42. A first lever 13a, a second lever 13b, a third lever 13c and a fourth lever respectively swingably supported by a shaft 14 of a body 170 via rollers 11a to 11d are swung in a predetermined cycle by the cams 12a, 12b, 12c and 12d in sequence.

The guide ruler 3 is secured to a guide ruler holder 28 and projects downward with a lower end portion extending rearward. A guide shaft composed of a pair of guide shafts 29 is secured to the guide ruler holder 28 at one end and extends perpendicularly upwardly from the guide ruler holder 28. This guide shaft is secured at its other end to block 30. Block 30 has a groove 31 therein for receiving a second upper link of a second link mechanism 5. The first guide shaft 29 vertically slidably penetrates a first thrust block 37. The first thrust block 37 is supported slidably horizontally, namely in the forward and rearward directions, by a first horizontal guide shaft 36 secured to the body 170. Block 37 is driven in the forward and rearward directions by a first link mechanism 4 which converts the swinging motion of the first lever 13a to horizontal motion, namely forward and rearward movements of the first thrust block 37. The guide shafts 29 are driven vertically, namely in upward and downward directions by the second link mechanism 5 which converts the swinging motion of the second lever 13b to vertical motion, namely upward and downward movements of the shafts 29. The guide ruler 3 is moved horizontally, namely upwardly and downwardly, by the vertical motion of the shafts 29.

The first link mechanism 4 comprises a bell crank 39 pivotally supported by the body 170 at the center thereof. An (a) link 38 has one end fixed to the first thrust block 37 and opposite end connected to an end of the bell crank 39 by a pin. A (b) link 40 has one end connected to the other end of the bell crank 39 and the opposite end connected to the first lever 13a for delivering a swinging motion of the first lever 13a to the other end of the bell crank 39 to thereby convert the swinging motion of the first lever to the horizontal motion of the first thrust block 37 whereby the guide ruler 3 is moved horizontally and vertically.

The second link mechanism 5 includes a swing lever 33 having middle portion swingably supported by the body 170 via a pin 32. A second upper link has one end connected to the swing lever 33 via the pin 32 and the other end slidably engaged in the guide groove 30 of the block 31 and capable of moving in a small distance within the guide groove 30. A second lower link 35 has one end connected to an end of the swing lever 33 and the other end connected to the second lever 13b for delivering swinging motion of the second lever 13b to the other end of the second lower link 35 to thereby convert the swinging motion of the second lever 13b to a vertical motion of the first guide shaft 29.

The guide ruler 3 is moved vertically and horizontally, namely, upwardly, downwardly, forwardly, rearwardly by the movement and the contour of the first cam 12a and the second cam 12b. These movements are effected in a predetermined cycle and illustrated in FIG. 4(*a*) as the downward movement, in FIG. 4(*d*) as the forward movement (leftward in FIG. 1), in FIG. (*e*) as the upward movement, the rearward movement (rightward in FIG. 1), the downward movement, and in FIG. 4(*j*) as the forward movement, the rearward movement returning to an original position.

The upper presser 18a is secured to the upper presser holder 16 and extends forwardly. The upper presser holder 16 has a second shaft 19 perpendicularly secured thereto. The second guide shaft 19 penetrates a second thrust block 20 and being vertically slidable therein. The second guide shaft 19 is driven by a third link mechanism 6 which converts a swinging movement of the third lever 13c to a vertical motion, namely upward and downward movements of the second guide shaft 19. The second thrust block 20 is slidably supported in forward and rearward direction by a second horizontal guide shaft 21 fixed to the body 170 and is driven by a fourth link mechanism 7 which converts a swinging motion of the fourth lever 13d to horizontal motion, namely forward and rearward movements of the second thrust block 20.

The third link mechanism 6 comprises a support member 22 vertically and slidably supported by a supporter 43 secured to the body 170. A slider 19a is secured to a lower end portion of the second guide shaft 19 and is slidably engaged in a horizontal guide groove 22a defined at an upper end portion of the support member 22. A third link 27 is connected between the lower end portion of the support member 22 and the third lever 13c for delivering a swinging motion of the third lever to a vertical motion of the second guide shaft 19. The slider 19a and the horizontal guide groove 22a constitute a relative movement mechanism 26 which allows the second guide shaft 19 and the support member 22 to move relatively forwardly and rearwardly.

The fourth link mechanism 7 includes a bell crank 24 slidably connected to the body 170 by a pin at the middle portion thereof. An (a) link 23 has one end fixed to the second thrust block 20 and a pin 23a at the other end engaged with an end of the bell crank 24. A (b) link 25 is connected between the other end of the bell crank 24 and the fourth lever 13d in a relatively swingable manner. The upper presser 18a is moved vertically and horizontally, namely, upwardly, downwardly, forwardly, rearwardly by the third cam 12c and the fourth cam 12d in response to the contours of the third and fourth cams 12c, 12d. These motions are effected just after starting the triple folding operation and illustrated in series sequentially in a predetermined cycle in FIG. 4(*b*) as the upward movement; in FIG. 4(*c*) as the forward movement and the downward movement; in FIG. 4(*f*) as the upward movement, the rearward movement, and the downward movement; in FIG. 4(*g*) as the forward movement; in FIG. 4(*h*) as the upward movement; in FIG. 4(*i*) as the forward movement, and the downward movement; and in FIG. 4(*k*) as the upward movement, the rearward movement, and the downward movement.

The lower presser 18b disposed under the upper presser 18a is supported slidably in the forward and the rearward directions by the upper presser holder 16. Presser 16 is driven in the forward and the rearward directions by the the first drive unit 9 and presses the folded hem of the towel 1 between the working table 2 and the lower presser 18b.

Figure 4A:
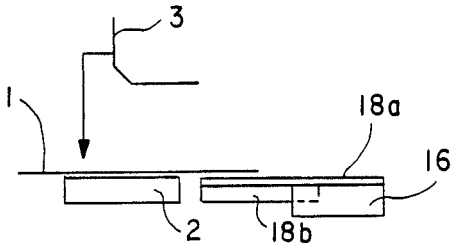
FIGS. 4(*a*) to 4(*l*) illustrate respectively the different sequential operations of the triple folding device in folding a hem of a towel.
Figure 4B:
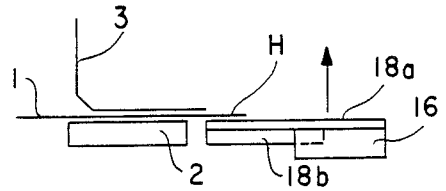
Figure 4C:
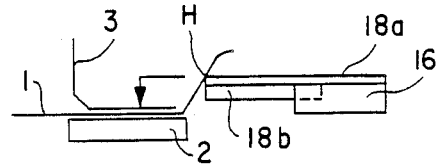
Figure 4D:
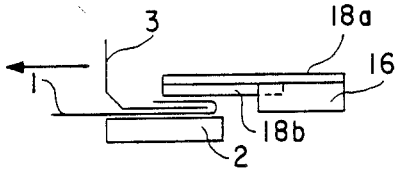
Figure 4E:
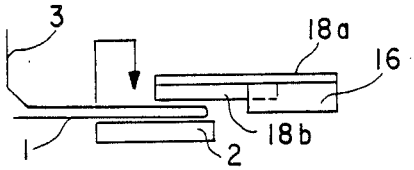
Figure 4F:
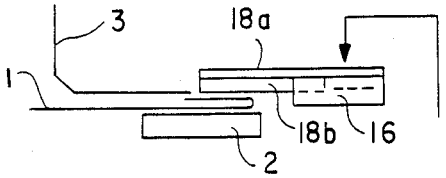
Figure 4:
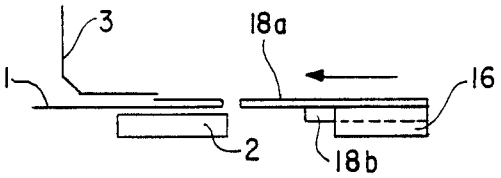
Figure 4H:
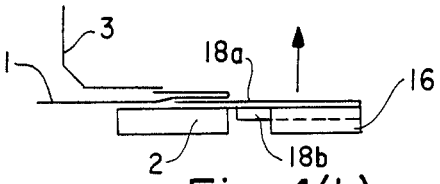
Figure 4:
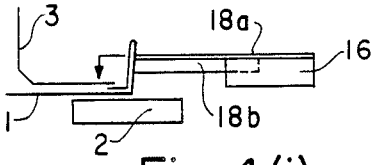
Figure 4:
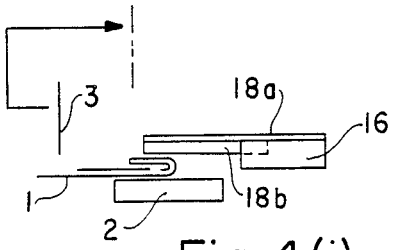
Figure 4K:
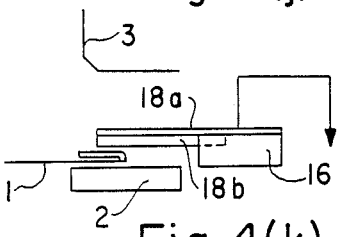
Figure 4L:
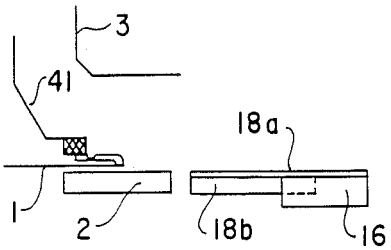

The first drive unit 9 provided at the upper presser holder 16 drives the lower presser 18*b* in the rearward position (rightward in FIG. 1) when the upper presser 18*a* is inserted between the double folded hem of the towel 1 and the working table 2, and drives the lower presser 18*b* to move in the forward direction and then return to the position under the upper presser 18*a* when the hem of the towel 1 is pressed down on the working table 2. The first drive unit 9 is controlled by a control unit in order to drive the lower presser 18*b* to move rearwardly after sensing a rearward movement of the upper presser holder 16 by a sensor as illustrated in FIG. 4(*f*) and to drive the lower presser 18*b* to move forwardly after sensing the upward movement of the upper presser holder 16 by a sensor as illustrated in FIG. 4(*h*). The first drive unit 9 according to the embodiment of the present invention is a double acting air cylinder.

The first lever 13*a*, the second lever 13*b*, the third lever 13*c* and the fourth lever 13*b* are respectively urged upwardly by a first return spring 15*a*, a second return spring 5*b*, a third return spring 15*c*, a fourth return spring 15*d* in order to maintain the engagement of the first lever 13*a* to the fourth lever 13*d* with the corresponding cams.

The pressing unit 41 which is a component of the delivering unit 140 presses the triple folded hem of the towel 1 between the working table 2 and the pressing unit 41 and is driven upwardly and downwardly by a pair of second drive units 8. The second drive units 8 respectively secured to the body 170 are lowered to press the triple folded hem of the towel 1 between the working table 2 and the pressing unit 41, and continue holding the triple folded hem of the towel 1 until the towel 1 is delivered to the stitching portion 150. The upward and returning movements of the guide ruler 3 is sensed by a sensor as illustrated in FIG. 4(*j*) and the second drive units 8 are controlled by a control unit on the basis of a value thus sensed. The second drive units 8 according to the embodiment of the present invention are double acting air cylinders. As evident from the arrangement of two pressing units 41, the triple folding devices 110 are arranged in a pair symmetrically at right and left sides as shown in FIG. 3, whereby the hems at both sides of the towel 1 are simultaneously triple folded.

A series of sequential operations of the triple folding device 110 are described with reference to FIGS. 4(*a*) to 4(*l*). The directions of movement of the upper presser 18*a*, the lower presser 18*b*, the guide ruler 3, and the pressing unit 41 are respectively represented by arrows.

The towel 1 which is cut off in a predetermined length by the cutting unit 130 and delivered to the triple folding device 110 is stopped with the hem thereof projected slightly longer from a rear edge portion of the working table 2 as shown in FIG. 4(*a*). The triple folding operation starts from this state.

In a first step as shown in FIG. 4(*a*), the guide ruler 3 is lowered to press the hem of the towel 1 between the guide ruler 3 and the working table 2 with the portion to be folded remaining at the end portion of the hem. The lowering motion or the downward movement of the guide ruler 3 is made by the second link mechanism 5. That is, the second lever 13*b* is swung upwardly by the second cam 12*b* whereby the second link 35 is moved upwardly to swing the swingable lever 33 to thereby lower the first guide shaft 29 via the block 31 which results in lowering the guide ruler 3.

In a second step as shown in FIG. 4(*b*), 4(*c*), the upper presser 18*a* which is flush with an upper surface of the working table 2 placed in an initial position is raised in response to the shape of the third cam 12*c* so that the hem of the towel 1 is raised. More in detail, the third lever 13*c* is swung upwardly by the third cam 12*c* to thereby permit the third link 27 to rise upwardly whereby the upper presser 18*a* is raised via the support member 22, the relative movement mechanism 26 (composed of the slider 19*a* and the horizontal guide groove 22(*a*), the second guide shaft 19, and the upper presser holder 16. The upper presser 18*a* is moved successively forwardly in response to the fourth cam 12*d*. More in detail, the fourth lever 13*d* is swung upwardly by the fourth cam 12*d* to thereby permit the fourth link 25 to move upwardly whereby the second thrust block 20 is slidably forwardly moved on the second horizontal guide shaft 21. As a result, the slider 19*a* is slidable on the horizontal guide groove 22*a* of the support member 22 and moved forwardly to permit the upper presser 18*a* to move forwardly via the second guide shaft 19 and the upper presser holder 16, which as a result the hem of the towel 1 is guided by a rear edge of the guide ruler 3 and double folded.

Then, the upper presser 18*a* is lowered and the double folded hem of the towel 1 positioned between the lower presser 18*b* and the working table is pressed by the lower presser 18*b*.

In a third step as shown in FIG. 4(*d*), the guide ruler 3 is moved forwardly to move away from the space established between the double folded hem of the towel 1. The forward movement of the guide ruler 3 is provided by the first link mechanism 4. That is, the first lever 13*a* is swung upwardly by the first cam 12*a* to thereby permit the first (b) link 40 to move upwardly whereby the bell crank 39 is swung to move the first (a) link 38 forwardly, and the first slide block 37 to slide on the first horizontal guide shaft 36, the first guide shaft 29 to move forwardly, and the guide ruler 3 to move forwardly. The guide ruler 3 moved away from the space defined between the hem of the towel 1 is raised, moved rearwardly, and lowered as shown in FIG. 4(*e*). The raising motion of the guide ruler 3 is caused, opposite to the lowering motion thereof, by the downward swinging motion of the second lever 13*b* of the second link mechanism 5. The rearward movement is made, opposite to the forward movement thereof, by a downward swinging motion of the first lever 13*a* of the first link mechanism 4. As a result, a front edge of the double folded hem of the towel 1 is pressed by the edged portion of the guide ruler 3 to prevent the shape of the hem from being deformed.

In a fourth step as shown in FIG. 4(*f*), the lower presser 18*b* is moved rearwardly by the first drive unit 9 while the upper presser 18*a* is moved rearwardly by the first drive unit 9 while the upper presser 18*a* accompanied by the lower presser 18*b* is successively raised, then moved rearwardly, and lowered whereby the upper presser 18*a* is located under the rear portion of the double folded hem of the towel 1. A lower surface of the upper presser 18*a* is positioned slightly higher than the upper surface of the working table 2. The rearward movement of the upper presser 18*a* is caused, opposite to the forward movement thereof, by the swinging motion of the fourth lever 13*d*.

In a fifth step as shown in FIG. 4(*g*), the upper presser 18*a* is moved forwardly to insert thereof between the double folded hem of the towel 1 and the working table 2. At this state, the lower presser 18b is moved sufficiently rearwardly relative to the upper presser 18a so that the lower presser 18b does not strike against the working table 2.

In a sixth step as shown in FIGS. 4(*h*), 4(*i*), the upper presser 18a is raised, then moved forwardly and finally lowered. As a result, the double folded hem of the towel 1 is restricted by the edge portion of the guide ruler 3, and is triple folded.

In a seventh step as shown in FIG. 4(*j*), the guide ruler 3 is moved forwardly while it is moved away from the triple folded hem of the towel 1, then raised, and finally moved rearwardly so that the guide ruler 3 is returned to the original position.

In an eighth step as shown in FIGS. 4(*k*), 4(*l*), the upper presser 18a is raised, then moved rearwardly, and lowered successively to thereby permit the upper presser 18a to return to the original position while the pressing unit 41 is lowered to press the front edged portion of the triple folded hem of the towel 1 between the pressing unit 41 and the working table 2 thus preventing the triple folded hem of the towel 1 from being deformed by an elastic force of the towel 1, whereby the towel 1 is delivered to the stitching portion 150 by the delivering unit 140 while a new towel material 1 delivered from the cutting unit 130 is placed on the working table 2.

A series of sequential operations is each step are repeated in a predetermined cycle.

The extent of the forward and rearward movements of the guide ruler 3 are limited within an effective length of the first (a) link 38 or the first (b) link 40, namely the guide ruler 3 can be moved forwardly or rearwardly within the effective length of the length of the first (a) link 38 or the first (b) link 40. The extent of the forward and rearward movements of the upper presser 18a are limited within a radius of operation which is adjusted by fulcrums of the fourth (a) link 23 and the fourth (b) link 25 respectively connected to the bell crank 24 by the pin, namely, the upper presser 18a can be moved within the radius of operation of the bell crank 24.

The triple folding device for folding a hem of a towel according to the present invention has the following advantages:

1. Since the drive unit of the triple folding device composed of the single rotative drive source 42 for rotatively driving the first cam, the second cam, the third cam, and the fourth cam, and the first drive unit for driving the lower presser to move forwardly and rearwardly, the triple folding device is manufactured with simplicity and low cost and the control thereof is made with ease.

2. Inasmuch as the first cam, the second cam, the third cam, and the fourth cam are rotatively driven by a single rotative drive source, all the cams are simultaneously operated with safety.

3. Inasmuch as only the lower presser presses the hem of the towel just after the hem is folded between the lower presser and the working table, if the lower presser is appropriately strengthened, the operating life of both the upper and lower pressers can be prolonged.

Although the invention has been described in its preferred form with a certain degree of particularity, it is to be understood that many variations and changes are possible in the invention without departing from the scope thereof.

What is claimed is:

1. A triple folding device for folding a hem of a towel comprising:

a first cam, a second cam, a third cam, and a fourth cam respectively fixed to a main shaft and driven by a single rotative drive source;

a first lever, a second lever, a third lever, a fourth lever respectively swingably supported by a shaft of a body of a sewing machine and swung by said first cam, said second cam, said third cam, and said fourth cam via rollers;

a first thrust block fixedly supported by a first horizontal guide shaft fixed to the body and having a through hole therein;

a first link mechanism having one end fixed to said first thrust block and another end connected to said first lever so that a swinging motion of said first lever is converted to a horizontal motion of said first thrust block;

a block connected to a guide ruler holder by a first guide shaft composed of a pair of guide shafts, said first guide shaft slidably penetrating said through hole of said first thrust block;

a second link mechanism having one end fixed to said block and another end connected to said second lever so that a swinging motion of said second lever is converted to a vertical motion of said first guide shaft;

a working table fixed to said body to which a towel material having a hem at one end thereof is delivered;

a guide ruler fixed to said guide ruler holder and positioned over said working table, said guide ruler movable horizontally by horizontal motion of said first thrust block and vertically by vertical motion of said first guide shaft whereby said guide ruler is moved downwardly by a lowering motion of said first guide shaft to thereby press the hem of the towel and movable forwadly by forward motion of said first thrust block to thereby move away from said hem of the towel;

an upper presser fixed to an upper presser holder for folding said hem of the towel, said upper presser holder having a second guide shaft fixed thereto;

a lower presser positioned under said upper presser and supported slidably horizontally by said upper presser holder;

a second thrust block supported by a second horizontal guide shaft fixed to said body for slidably vertically supporting said second guide shaft;

a third link mechanism having one end fixed to said second guide shaft and another end connected to said third lever so that a swinging motion of said third lever is converted to a vertical motion of said second guide shaft whereby said upper presser is moved horizontally;

a fourth link mechanism having one end fixed to said second thrust block and another end connected to said fourth lever so that a swinging motion of said fourth lever is converted to a horizontal motion of said second thrust block whereby said upper presser is moved vertically;

a first drive unit provided at said upper presser holder for driving said lower presser to move horizontally so that said lower presser is moved away from said hem of the towel when said upper presser is moved into said hem of the towel; and a pressing unit driven by a second drive unit for pressing and holding said folded hem of the towel laid between said working table and said pressing unit.

2. A triple folding device for folding a hem of a towel according to claim 1, wherein said first link mechanism comprises a bell crank pivotally supported by said body at center thereof, a first link having one end fixed to said first thrust block and another end connected to one end of said bell crank by a pin, and a second link having one end connected to (the other) another end of said bell crank and another end connected to said first lever for delivering the swinging motion of said first lever to said another end of said bell crank to thereby convert the swinging motion of said first lever to the horizontal motion of said first thrust block.

3. A triple folding device for folding a hem of a towel according to claim 1, wherein said second link mechanism comprises a swing lever having a middle portion swingably supported by said body via a pin, an upper second link having one end connected to said swing lever via said pin and another end slidably engaged in said guide groove, and a lower second link having one end of said swing lever and another end connected to said second lever for delivering the swinging motion of said second lever to said another end of said second lower link to thereby convert the swinging motion of said second lever to the vertical motion of said first guide shaft.

4. A triple folding device for folding a hem of a towel according to claim 1, wherein said third link mechanism comprises a support member vertically and slidably supported by a supporter fixed to said body, a slider fixed to a lower end portion of said second guide shaft and slidably engaged in a horizontal guide groove defined at an upper end portion of said support member, a third link connected between said lower end portion of said support member and said third lever for converting the swinging motion of said third lever to a vertical motion of said second guide shaft.

5. A triple folding device for folding a hem of a towel according to claim 2, wherein said fourth link mechanism comprises a bell crank slidably connected to said body by a pin at the middle portion thereof, a fourth upper link having one end fixed to said second thrust block and another end engaged with one of said bell crank, a fourth lower link having one end connected to another end of said bell crank and the other another end connected to said fourth lever for converting the swinging motion of said fourth lever to a horizontal motion of said second guide shaft.

* * * * *